US005417090A

United States Patent [19]

Baumann

[11] Patent Number: 5,417,090

[45] Date of Patent: May 23, 1995

[54] CIRCULAR KNITTING MACHINE CLEANING APPARATUS

[75] Inventor: John Baumann, Islip, N.Y.

[73] Assignee: Uniwave, Inc., Farmingdale, N.Y.

[21] Appl. No.: 296,224

[22] Filed: Aug. 25, 1994

Related U.S. Application Data

[63] Continuation of Ser. No. 49,002, Apr. 19, 1993, abandoned.

[51] Int. Cl.[6] ..... D04B 35/32; A47L 15/00; F01D 25/28

[52] U.S. Cl. ..... 66/168; 15/312.1; 416/244 R; 415/213.1

[58] Field of Search ..... 66/168, 8; 15/300.1, 15/301, 312.1, 316.1; 416/244 R; 415/213.1

[56] References Cited

U.S. PATENT DOCUMENTS

| | | | |
|---|---|---|---|
| Re. 15,705 | 10/1923 | Glasser | 15/312.1 X |
| D. 299,858 | 2/1989 | Davis | D23/379 |
| 1,339,182 | 5/1920 | Farrell | 15/312.1 X |
| 1,480,721 | 1/1924 | Glasser . | |
| 1,939,481 | 12/1933 | Albers | 15/312.1 X |
| 2,063,873 | 12/1936 | Hodge | 15/20 |
| 2,063,874 | 12/1936 | Hodge | 15/20 |
| 2,478,829 | 8/1949 | Lechtenberg | 416/244 |
| 2,610,349 | 9/1952 | Moore | 15/312.1 X |
| 3,072,321 | 1/1963 | King, Jr. . | |
| 4,505,136 | 3/1985 | Tsay | 66/168 |
| 5,175,905 | 1/1993 | Gutschmidt | 15/312.1 |

FOREIGN PATENT DOCUMENTS

| | | | |
|---|---|---|---|
| 2621946 | 12/1977 | Germany | 66/168 |
| 2842819 | 4/1980 | Germany . | |

OTHER PUBLICATIONS

Advertisement, Knitting Times, Apr., 1985, p. 69.

*Primary Examiner*—John J. Calvert
*Attorney, Agent, or Firm*—Schweitzer Cornman & Gross

[57] ABSTRACT

An apparatus for removing lint and debris from circular knitting machines has a rotating arm positioned such that its distal end sweeps about the periphery of the machine. A fan motor unit located at the distal end is mounted for 360 degree rotation in a plane perpendicular to the plane of arm rotation, allowing the sweep of air to contact both the machine surface as well as adjacent areas. The fan/motor unit is preferably rotated by an arm mounted rotation motor, coupled to the unit by a commutator. The rotational rates of the central drive and the rotation drive are chosen to allow the path about the machine circumference described by the fan/-motor unit to vary upon successive arm revolutions to insure a fan sweep over all machine surfaces.

7 Claims, 3 Drawing Sheets

CIRCULAR KNITTING MACHINE CLEANING APPARATUS

This is a continuation of application Ser. No. 08/049,002, filed on Apr. 16, 1993, now abandoned.

BACKGROUND OF THE INVENTION

The present invention relates to the textile arts and, in particular, to an apparatus adapted to provide for the removal of lint, dust and other unwanted materials from a circular knitting machine.

It is well known and recognized that the processing of textile fibers, including the knitting thereof into fabric, generates large quantities of fiber lint and other debris. This debris often permeates the environment in which the processing equipment is located, and settles on the exposed surfaces of the equipment. It is well recognized that the continued accumulation of the debris, especially on the active machinery elements, can result in unsatisfactory operation, and possible ultimate machinery failure. In addition, the debris can be trapped in the produced fabric, creating defects therein.

Debris accumulation and contamination is a significant problem in circular knitting machines, which because of their size can generate a large amount of lint and other debris. Such large machines can have a diameter of many feet, utilizing a large number of reciprocating needles and associated devices, including yarn feeds and linkages needed to synchronize the knitting process. Associated with such operation is the generation of an often prodigious amount of lint and other debris.

In order to limit the amount of such debris accumulating on the equipment, and to remove the debris therefrom, a variety of fan-type apparatus have been developed. The device set forth in U.S. Pat. No. 5,195,337 to Alan Gutschmidt presents a typical apparatus, As disclosed therein, a cleaning device for a circular knitting machine includes a centrally mounted arm journaled for 360 degree rotation about a central mounting, typically positioned at the center of the knitting machine, A fan is mounted at the distal end of the arm, and oscillates in a vertical plane over a limited angle to direct a flow of air over portions of the knitting machine as the arm rotates.

BRIEF SUMMARY OF THE INVENTION

Because of the perceived shortcomings in the operation of the cleaning devices of the prior art, it is an object of the present invention to provide a cleaning apparatus particularly adapted for utilization in conjunction with a circular knitting machine, having superior debris removing and lint limiting capabilities.

In accordance with such and other objects, the present invention comprises a fan or blower assembly, consisting of a fan and coupled drive motor, mounted at the distal end of a rotating support arm, the arm being mounted and driven for rotation in a horizontal plane about the full circumference of a circular knitting machine, The fan-motor assembly is mounted in a pivoting support which allows full 360 degree rotation of the assembly about an axis perpendicular to the arm axis and preferably lying in a horizontal plane. The fan blast thus describes a full vertical circle, allowing all surfaces of the knitting machine to be swept by the thrust of air as the fan simultaneously rotates about two perpendicular axes. The combination of motions provides for efficient lint and other debris removal over a greater extent of the knitting machine than has heretofore been possible. In addition, the device permits the cleaning of lint from the factory ceilings, rafters and surrounding areas. Such lint would normally have the ability of falling onto the machine, causing further contamination of the machine and fabric.

DESCRIPTION OF THE DRAWINGS

A fuller understanding of the present invention and the features thereof will become apparent upon consideration of the following detailed description of a preferred, but nonetheless illustrative embodiment of the invention, when reviewed in consideration with the annexed drawings, wherein.

DETAILED DESCRIPTION OF THE INVENTION

Figure 1:
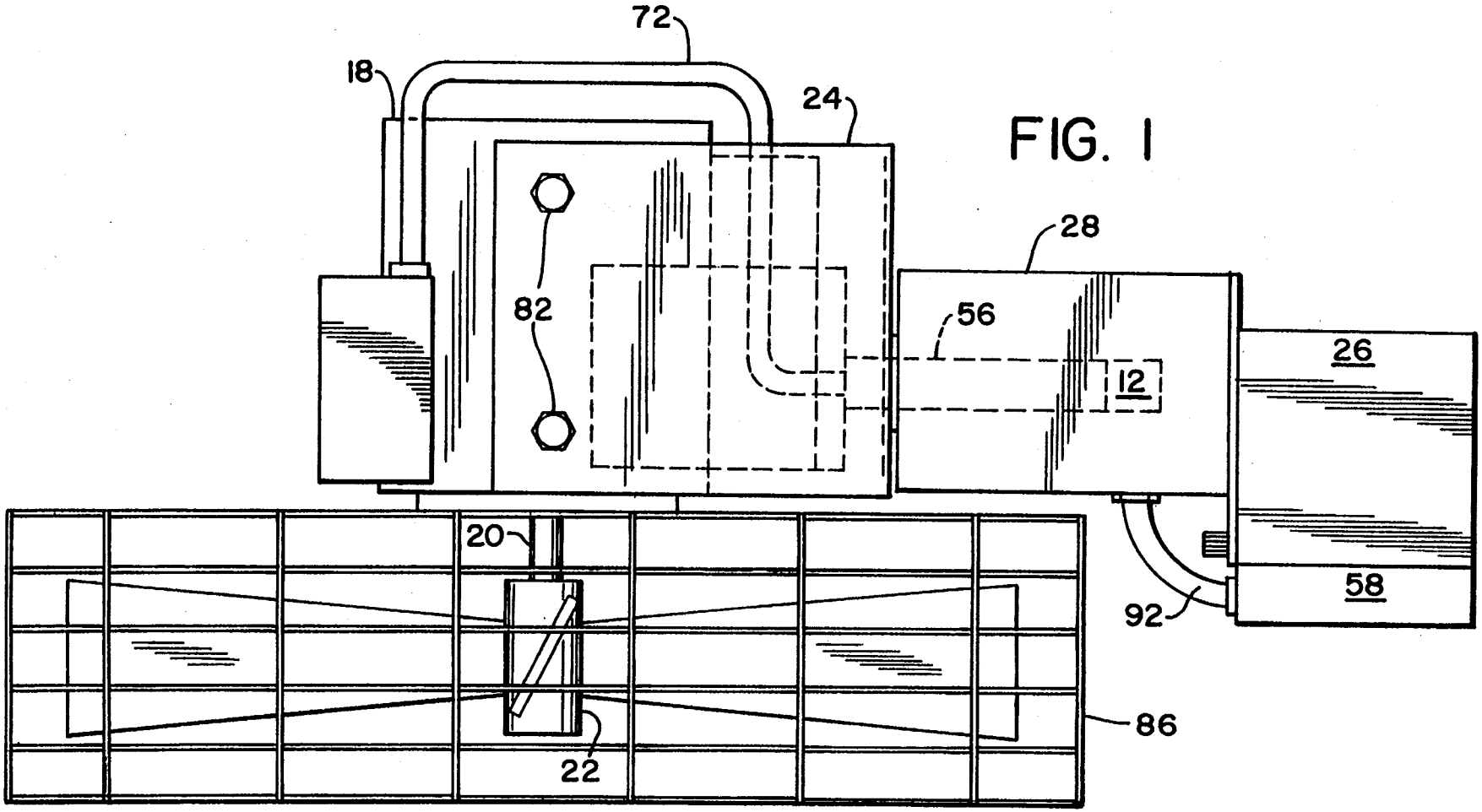
FIG. 1 is a side elevation view of the distal end of the rotating arm of the invention, depicting the fan apparatus mounted thereto.
Figure 2:
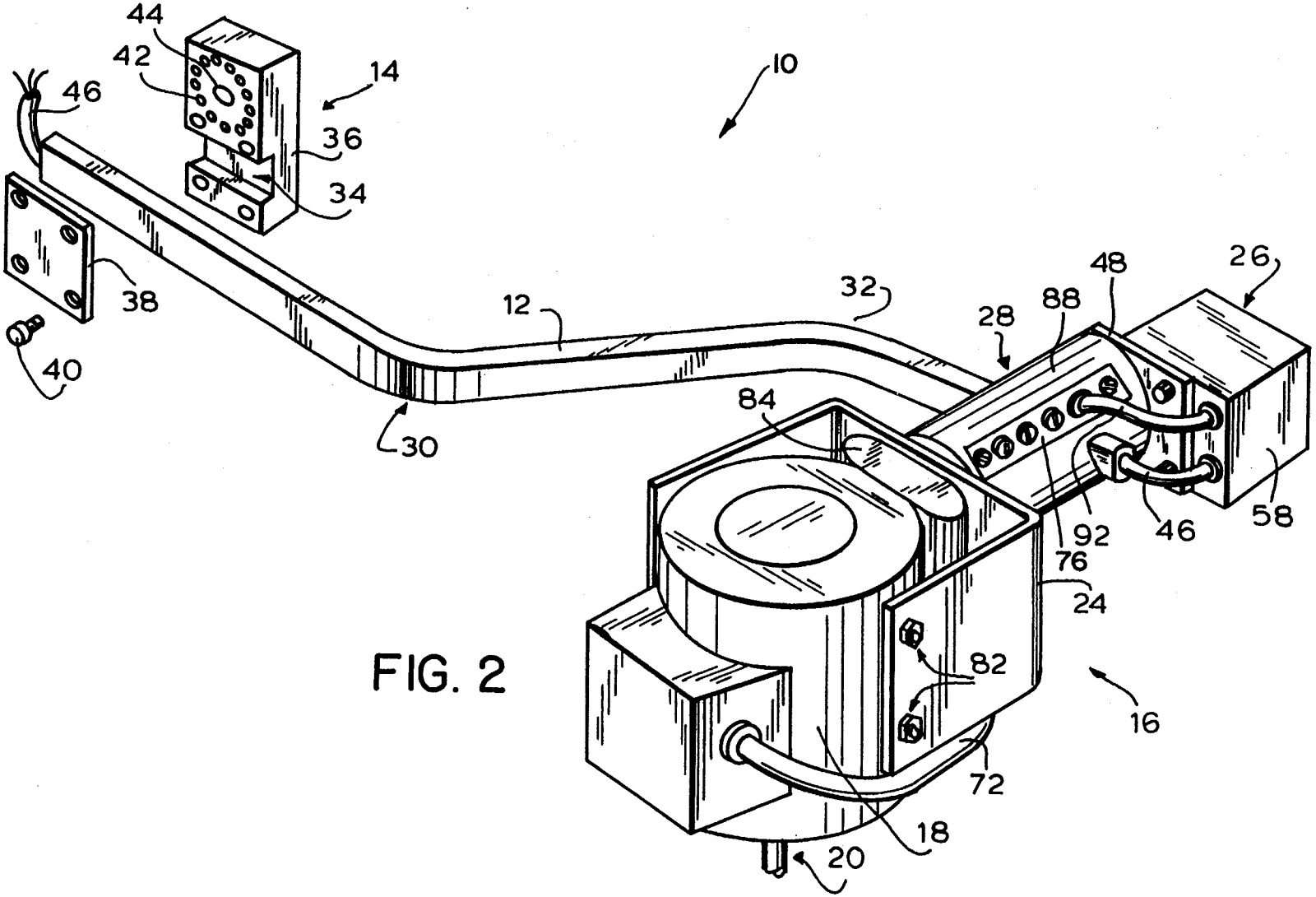
FIG. 2 is a perspective view of the invention.

With reference to the Figures, the present invention 10 includes arm 12 supported within mounting block 14 at its central, proximal end and having fan/blower assembly 16 at its distal end. The fan assembly 16 includes a fan motor 18 having shaft 20 to which the fan 22 is affixed; a clevis assembly 24 to which the blower motor 18 is attached; a rotation drive motor 26; and a commutator assembly 28 which transmits the rotational energy developed by the motor 26 to the blower motor and fan while allowing continuous electrical contact to be maintained with the motor 18.

The arm 12 may be constructed of rectangular steel tubing with a pair of angular bends 30, 32 which allow the substantial mass of the blower motor and fan 18, 20 to be aligned along the main axis of the arm. A central drive (not shown) provides 360-degree rotation for the arm about its proximal end. The arm is clamped in recess 34 in main mounting block 36, to which the central drive is connected as known in the art. A cover plate 38 is affixed to the mounting block by use of bolts 40, and clamps the arm securely within its accepting recess. The block 36 may be provided with a plurality of bores 42 in its upper section, arranged in a circular pattern about central bore 44, to provide an indexing mechanism to adjust the angular positioning of the mounting block 14 and arm assembly affixed thereto in a vertical with respect to the central drive apparatus. The drive apparatus may include a set of slip rings (not shown) to permit electrical power to be transferred to the cable 46 which is positioned within the arm 12 and leads to its distal end, where it provides electrical power to the fan assembly as hereinafter set forth.

The distal end of the arm 12 supports the blower fan and drive motor, along with the commutator assembly 28 and rotation motor 26, and may, for example, be affixed to the commutator housing 88 to which the housing 28 may be formed with an extending end plate 48, to which drive motor 26 is mounted. The end plate is provided with a bore 50 through which the motor shaft 52 projects inwardly, into the body of the housing. A pair of ball bearing races 54, mounted at opposed ends of the commutator housing, support the commutator shaft 56 for rotation. The proximal end of the commutator shaft accepts motor shaft 52 in a bore at its first end, the commutator shaft projecting outwardly from the opposite end of the commutator housing, where it is affixed to clevis 24.

Mounted upon the commutator shaft 56 within the housing is slip ring assembly 60, which allows electrical power to be passed without interruption to the fan motor 18 which is mounted to clevis 24 and which is continuously rotated by the action of rotation motor 26. The slip ring assembly may comprise an insulating tube or cylinder 62 which is mounted to, and rotates with, commutator shaft 56. Mounted to the insulating tube are the conductive slip rings 64, each of which encircles the tube. Each ring is provided with an electrical lead 66 which is directed into a bore 68 in the commutator shaft 56 and which extends inwardly from the distal end of the shaft. The bore may be capped with a bushing insert 70 to support and protect the jacket of cable 72 into which are directed the leads 66.

Figure 3:
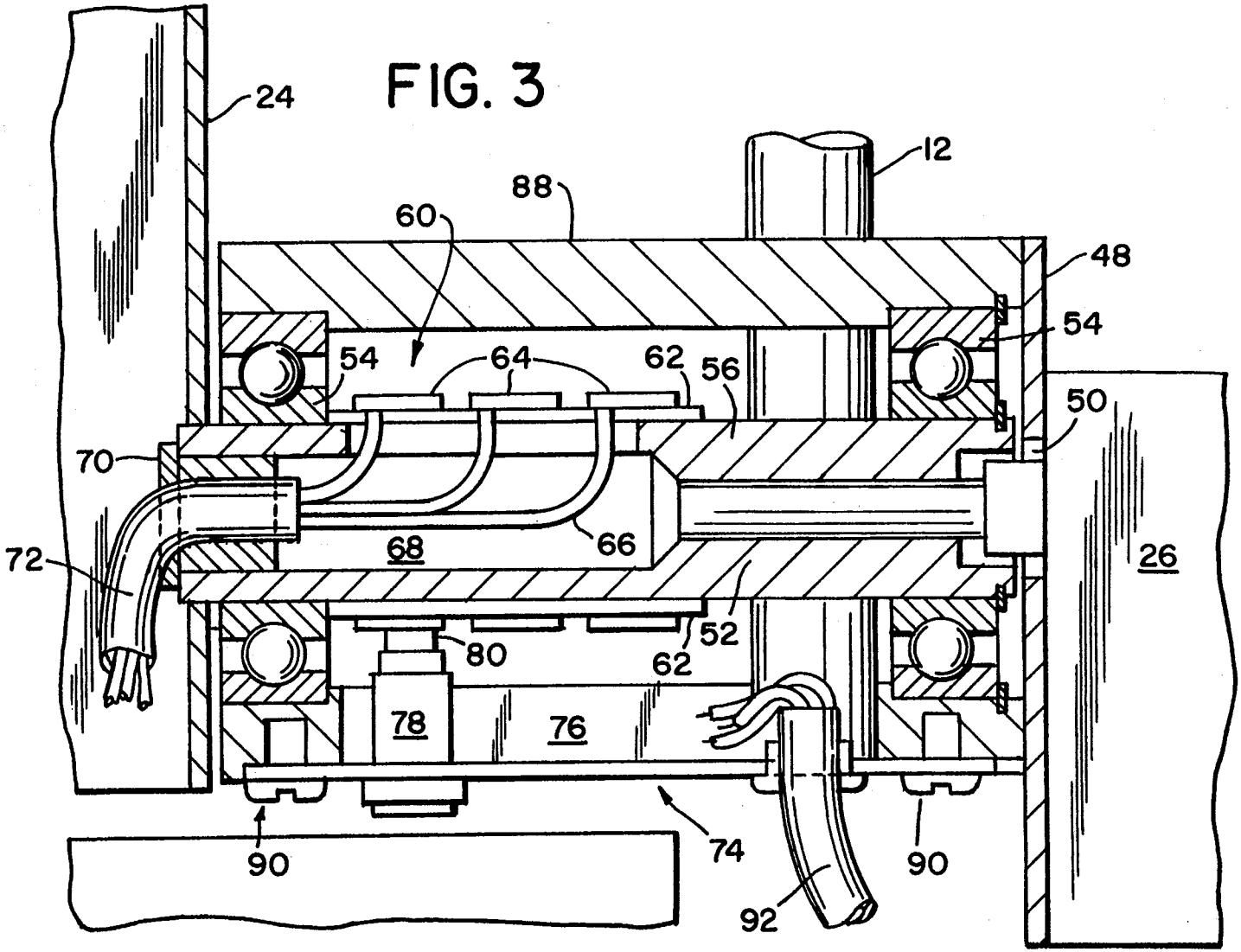
FIG. 3 is a sectional view in elevation of the invention.

Also mounted in the commutator housing is brush assembly 74, which is positioned to allow electrical current to be passed to the rotating slip ring assembly 60 within the commutator housing 88. Mounted in the panel portion 76, which may be mounted to the commutator housing 88 by bolts 90, are a set of spring-loaded wiping contacts or brush units 78, of which only one is shown in FIG. 3. Each brush unit includes a contact element 80, typically of graphite or similar material as known in the art, which is biased by an internal spring (not shown) into continuous rubbing contact with a respective one of the slip rings 64. As shown in the Figures, the slip rings and wipers may be three in number, transmitting single phase alternating current and a ground return from the stationary brush units to the rotating slip rings and hence to the fan motor 18. Appropriate connections are provided between the brushes and the electrical leads in cable 92 from the arm, as known in the art. As shown in the Figures, the arm cable 46 may terminate in junction box 58, wherein it is connected to leads for motor 26. Cable 92 returns to the commutator for connection to the brushes.

As best seen in FIG. 3, the distal end of commutator shaft 56 is affixed to clevis 24, causing the clevis to rotate with the shaft when rotation drive motor 26 is actuated. The arms of the clevis support the fan motor 18, the fan motor being rigidly mounted to the clevis by appropriate nut and bolt pairs 82. The fan motor is preferably mounted such that its shaft 20 is perpendicular to the axis of the commutator shaft 56. Cable 72 connects the motor 18 to the slip rings 64. Appropriate internal wiring for the motor 18 may be provided for a motor capacitor 84, mounted to the motor housing, if required, as known in the art. As best seen in FIG. 1, a wire grille 86 may be affixed to the housing of motor 18 to provide protection against the spinning blades of fan 22 mounted to the motor shaft.

In order to provide for effective cleaning of the machine surfaces, the rotational speeds of the main arm drive motor and rotation motor 46 should be chosen such that they are not in synchronism; that is, one should not be a multiple of the other. This avoids a sweep rotation pattern in which the sweep path of the fan repeats over the same portion of the knitting machine. Rotational speeds which are not synchronized allow the sweep path to vary during successive arm rotations, insuring that all surfaces are placed within the direct fan blast. It has been found that rotation rate ratios falling between 2:1 and 6:1 (fan rotation:arm rotation) at arm rotation rates of about 2–4 rpm provide effective results. Resulting offsets of up to about 25° on successive arm revolutions have been found acceptable.

With the blower unit mounted upon a central shaft having a main arm-rotating drive, as well as a slip ring assembly to allow electrical power to be passed to the cable 46 in the arm, the system is energized, and the arm commences rotation. Simultaneously, rotation motor 26 is energized, rotating commutator shaft 56 and thus clevis 24 and fan motor 18. The rotation is in a 360 degree full circle, the plane of the circle described by the rotation of the motor shaft 20 being vertical, and essentially along a radius from the arm's central mounting. Because electrical power is continuously provided to the fan motor during its rotation, fan 22 provides a continuously rotating circular sweep of air as the arm rotates. This corkscrew of airflow effectively removes accumulated lint from the surfaces of the knitting machine, and surrounding areas helping insure continuous, trouble free operation of the machine.

I claim:

1. A fan apparatus for use in conjunction with a circular knitting machine, comprising an arm having distal and proximal ends, the arm being mounted for rotation at said proximal end about a vertical axis, the portion of said arm adjacent said proximal end projecting along a radial ray extending from said vertical axis; a fan assembly comprising a fan and a fan motor mounted to the distal end of said arm for 360 degree rotation in a plane perpendicular to the plane of arm rotation, the distal end of said arm being offset from said radial ray to allow the mass of said fan and fan motor to be in radial alignment with said ray; drive means for rotating said fan motor in said perpendicular plane; and means for providing continuous electrical power to said fan motor during rotation thereof; said drive means comprising a drive motor having a housing rigidly mounted to said distal end of said arm and a shaft, and a clevis mounted to said shaft and supporting said fan motor.

2. The apparatus of claim 1, further comprising means coupled to said arm at said proximal end for rotating said arm at a first rotational speed, said drive motor comprising means for rotating said shaft at a rate which is chosen to provide an offset of the path of fan travel between sequential revolutions of said arm.

3. The apparatus of claim 2, wherein said offset is up to about 20°.

4. The apparatus of claim 2, wherein the ratio of rotational speeds between said arm and said fan is between about 1:2 and 1:6.

5. The apparatus of claim 1 further comprising a mounting block having a groove therein dimensioned to accept said proximal end of said arm, said mounting block having means for varying the angular position of said arm with respect to said vertical axis.

6. The apparatus of claim 5, wherein said adjusting means comprises a plurality of indexing bores positioned about a central axis.

7. The apparatus of claim 1, wherein said means for providing electrical power comprises a commutator coupled to said rotation motor and said clevis.

* * * * *